United States Patent [19]

Miller

[11] 4,102,162

[45] Jul. 25, 1978

[54] PADLOCK HAVING GUIDED WEDGES FOR RESISTING DESTRUCTIVE WEDGE ATTACK

[75] Inventor: James Clayton Miller, Nicholasville, Ky.

[73] Assignee: Sargent & Greenleaf, Inc., Nicholasville, Ky.

[21] Appl. No.: 839,459

[22] Filed: Oct. 3, 1977

[51] Int. Cl.[2] ..... E05B 67/02; E05C 19/08

[52] U.S. Cl. ..... 70/52; 292/281; 70/417

[58] Field of Search ..... 70/51, 52, 417; 292/281–286, 342, 343

[56] References Cited

U.S. PATENT DOCUMENTS

| | | | |
|---|---|---|---|
| 3,638,460 | 2/1972 | Berry | 70/52 |
| 3,759,557 | 9/1973 | Athes | 292/281 |
| 3,858,923 | 1/1975 | Bunn | 292/281 |

*Primary Examiner*—Robert L. Wolfe
*Attorney, Agent, or Firm*—Mason, Fenwick & Lawrence

[57] ABSTRACT

A high security padlock for use with a pair of companion locking bars having apertured hasp end portions to be disposed in alined abutment and locked together, the padlock comprising a padlock body having a rearwardly opening cavity to receive the alined abutting hasp end portions therein and the padlock including a shackle extending through said cavity to pass through a pair of alined apertures in the hasp end portions, and a lock mechanism with the padlock body, together with wedge-attack-resisting wedge members flanking opposite sides of the pair of alined hasp end portions each having a front portion disposed in the rearwardly opening cavity of the lock body and rear portions protruding rearwardly beyond the rear surface of the lock body. The wedge members have shaped surfaces coactive with surfaces of the cavity to impart a component of lateral movement to the wedge members when an attack wedge-like tool is driven against the rear of the lock body into engagement with the rearwardly projecting end portions and cause surfaces of the wedge members to tightly grip the hasp end portions against withdrawal.

11 Claims, 9 Drawing Figures

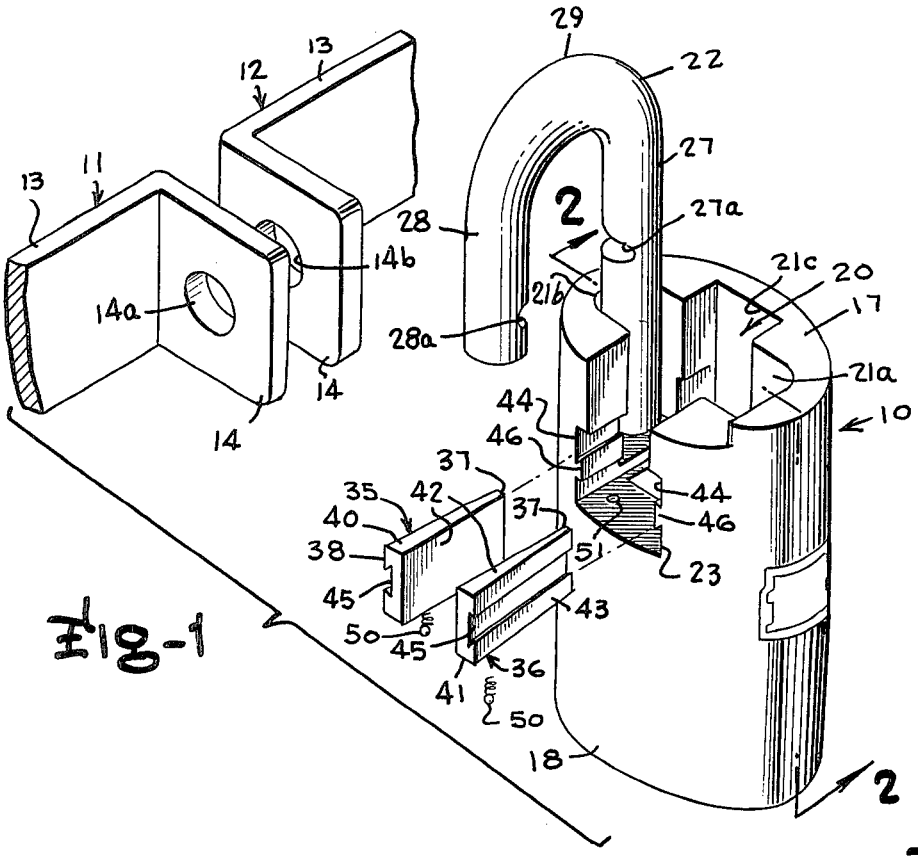
Fig-1
Fig-2
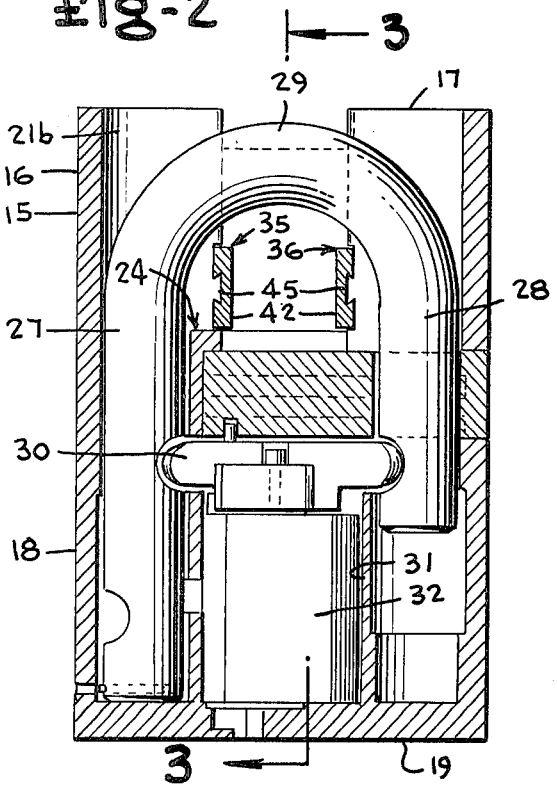
Fig-3
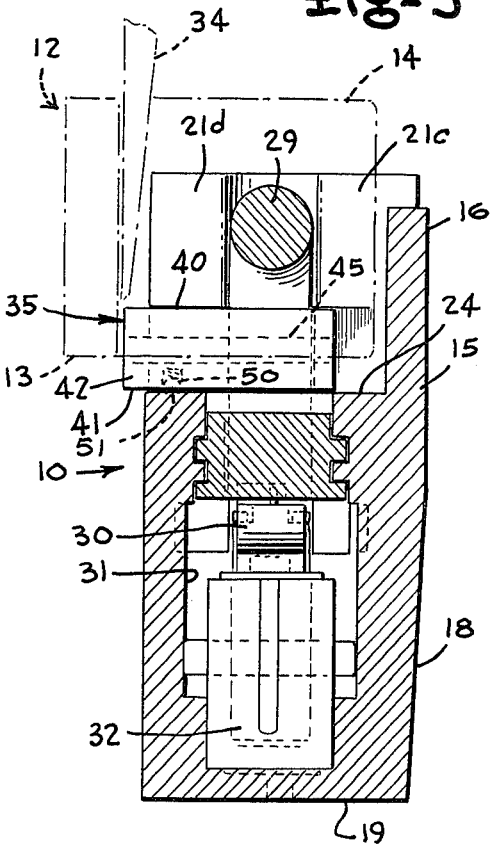

PADLOCK HAVING GUIDED WEDGES FOR RESISTING DESTRUCTIVE WEDGE ATTACK

BACKGROUND AND OBJECTS OF THE INVENTION

The present invention relates in general to high security lock devices for use with paired adjacent staple formations of locking bars or so-called hasps, one or both of which may be L-shaped flange bars, whereby the adjacent alined staple formations receive a locking bolt or shackle therethrough and are shrouded or surrounded forwardly and laterally by the lock device for protection against attack by persons seeking unauthorized forced opening of the locking assembly.

The conventional type of padlock previously used with hasp and staple assemblies for locking doors, security containers and the like have usually included a U-shaped shackle formed of a pair of spaced parallel straight legs joined by a curved intermediate portion, together with a padlock body provided with a key lock plug or combination locking mechanism and bolt means within the padlock body for interlocking with grooves or notches in the shackle leg portions which extend into shackle sockets or openings in the padlock body. In the locked position, the U-shaped shackle normally projects in exposed upstanding relation from the padlock body and is thus exposed to attack by cutting instruments or other burglary tools. In many applications were padlocks have been previously used, the padlock was in an exposed environment where it was not under constant supervision by security personnel, watchmen, or people charged with protecting the area in which the lock was located. In such exposed or unsupervised padlock situations, a person seeking unauthorized entry into the space secured by the padlock had the opportunity to open the lock by any of a number of conventional techniques, such as picking, rapping, sawing, or forcing the padlock open by inserting a wedge type tool between the hasp members and padlock body or shackle to wedge or chisel the lock open.

In recent years, much effort has been devoted to improving lock security for the doors or closures in such exposed situations, by providing a pair of steel plate locking bar members having staple, loop or apertured flange formations, for example a pair of locking bars or L-shaped steel flange plates or straight hasp plates, each having a foot or base portion to be fastened by tamper-resisting screws to adjacent mounting surface portions of a pair of doors, or of a door and door jamb or comparable surface with the plates each providing an integral outwardly projecting apertured staple or loop formation to be disposed in mated or laterally alined relation and secured by a hardened high security padlock shackle. To further improve security, the number of pin tumblers or levers employed in the key cylinder or key locking plug of such padlocks has been increased and the key cylinder made to resist drilling, picking and similar attack techniques. To protect the shackle against attack from the sides and from all directions by sophisticated cutting instruments, hardened padlock bodies have been developed having shroud formations which shield the sides and front of the shackle from attack by cutting instruments.

In some of such locks, the shackle is completely recessed in the padlock body in locked position and the shackle recess has a rearwardly opening slot to receive the pair of outwardly projecting flat apertured flange or staple formations of the locking bars with the padlock shackle passed through the apertures in the flange or staple formations interfitted into the rearwardly opening recess of the lock body. Examples of padlocks of the shroud type and of other lock devices designed for use with similar locking bars are found in prior U.S. Pat. Nos. 3,652,114 to Cady, 3,759,557 to Athas, 3,769,821 and 3,817,062 to Randel, 3,858,923 to Bunn, 3,901,058 and 3,996,774 to Best, 3,744,280 to Brown and 3,638,460 to Berry. FIG. 8 of U.S. Pat. No. 3,710,603 and FIG. 10 of 3,713,309 to Miller, both assigned to the assignee of the present application, also show shrouded shackle padlocks with a cruciform shaped recess in the upper end portion of the padlock body opening rearwardly to receive the laterally juxtaposed forwardly projecting apertured legs or end flanges of such locking bars.

A particular problem with these L-shaped flange type locking bars secured by padlock or enshrouding lock devices has been the ability of burglars or unauthorized persons to force the lock off of the locking bars by driving a wedge down between the rear portion of the lock body and the locking bars and thereby tear the shackle forwardly through the apertured end portion of the locking bars and thereby destroy the holding action of the lock on the locking bars.

An object of the present invention is the provision of a novel anti-wedge shackle lock construction for use with L-shaped flange type locking bars or the like constructed so that attack on the lock mechanism with destructive wedges to attempt to force it off the apertured end or flange portions will further increase binding action of guided attack resisting wedges flanking the apertured end or flange portions as the destructive wedges are driven, providing additional strength and support to the locking bar flanges and shackle.

Another object of the present invention is the provision of a novel anti-wedge padlock of the type described in the preceding paragraph, wherein the lock body is provided with sliding wedge members guided by dove-tail tongue and groove formations at opposite sides of the pair of locking bar apertured portions to protect the same against forced entry by wedges forced between the lock body and locking bars.

Yet another object of the present invention is the provision of a novel shackle type locking device of the concealed or shrouded shackle type adapted for use with L-shaped flange type locking bars and the like, wherein progressively tighter grasping or binding against the apertured end or flange portions is achieved responsive to movement of destructive wedges relative to the lock body during attempted forced entry by wedge attack.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is an exploded perspective view of a shrouded shackle padlock constructed in accordance with the present invention, with the shackle swung to open position and shown adjacent a pair of L-shaped flange type locking bars with which the same is designed to be used;

FIG. 2 is a vertical transverse section view of the padlock, taken along the transverse side-to-side axis along the line 2—2 of FIG. 1;

FIG. 3 is a vertical section view thereof taken along the fore and aft vertical plane indicated by the line 3—3 of FIG. 2, showing an attack driving wedge in broken lines positioned to begin attack on the lock;

DETAILED DESCRIPTION OF PREFERRED EMBODIMENTS

Figure 4:
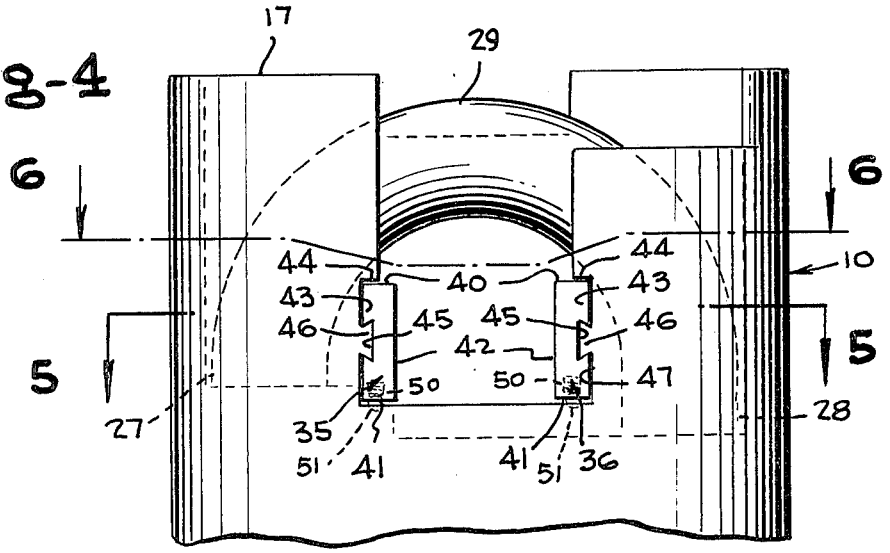
FIG. 4 is a fragmentary rear elevation view of the rear upper end portion of the padlock in the region of the rearwardly opening slot portion of the shackle and locking bar flange recess, to enlarged scale, showing the anti-wedge mechanism of the present invention.

Referring to the drawings, wherein like reference characters designate corresponding parts throughout the several figures, there is illustrated in FIGS. 1, 2 and 3 a shrouded shackle padlock, indicated generally by the reference character 10, embodying the construction of the present invention and designed to be used with a pair of locking bars 11, 12 of the L-shaped flange type. The locking bars, as illustrated, are of L-shaped steel plates having a flat foot or base mounting portion 13 adapted to be secured by tamper-proof screws, not shown, to mounting surfaces, for example the forwardly facing adjacent surface portions near the meeting edge of a pair of sliding doors, and having at the ends of the mounting foot or base portions 13 which are nearest each other outwardly projecting flanges 14 which are of rectangular or near rectangular profile, forming heavy apertured hasp portions or what may be called locking ears or staple formations 14, designed to be abutted in side-by-side registered relation when the doors are closed to be secured tightly together in that condition. In this manner, the apertured hasp portions 14 project outwardly substantially perpendicular to the mounting surfaces of the doors to which they are secured. It will be appreciated, of course, that the base or foot portions 13 of the bars may be of other configurations than that shown in the drawings, and may, for one of the locking bars, extend rearwardly in the same plane at the outwardly projecting hasp portion 14 of that locking bar, where it is desired to mount that locking blar on the face of a door jamb or frame surrounding the door opening and lying perpendicular to the front face of the door, in which case that locking bar serves as a conventional keeper. In either case, the hasp portion 14 of the locking bar 12, whether it is an L-shaped angle member or a flat plate member, is designed to be disposed in laterally alined registering abutment with the apertured hasp portion 14 of the companion locking bar 11 in the locked condition.

The padlock body 15 of the shrouded shackle padlock herein illustrated is of generally elliptical configuration in top plan view, having an upper end portion 16 terminating in a top surface 17 and having a lower end portion 18 terminating in a bottom surface 19. The padlock body 15 is preferably a unitary casted body, formed for example of hardened steel, and in the illustrated embodiment has an upwardly opening cruciform shaped recess 20 opening through the top surface 17 and extending through a predetermined height inwardly therefrom through the upper end portion 16 of the padlock body having lateral wings or recess extensions 21a, 21b extending in a first lateral or side-to-side plane defining the portion of the recess shaped and sized to accommodate the padlock shackle 22 and having a front wing or recess extension 21c extending forwardly in a second fore and aft plane perpendicular to the first mentioned plane and a rearward extension forming a slot 21d opening through the rear of the upper end or shroud portion of the padlock body at the location indicated at 23 to define a recess for snuggly accommodating the apertured hasp portions 14 of the pair of locking bars 11 and 12 with the shackle 22 extending through the apertures 14a, 14b of the hasp portions 14. At the foot or bottom of the cruciform shaped recess 20, which forms a shackle and staple flange receiving recess, a shoulder formation or surface 24 is provided which is interrupted by a pair of closed bottom sockets or bore 25, 26 extending downwardly through the surface 24 for receiving the legs of the shackle 22.

The shackle 22 is preferably in the form of a U-shaped rod of hardened steel material having a longer shackle leg 27 and a shorter shackle leg 28. The longer shackle leg 27 passes through the circular entrance opening at the top of the socket in the intermediate surface 24 of the padlock body at the bottom of the recess 20 and extends a substantial distance within the padlock body 15 toward the bottom surface 19. The longer shackle leg 27 is permitted a selected amount of axial and rotary movement relative to the padlock body 15, but is normally restrained against withdrawal from the socket 25 by the usual restraining pin provided in the padlock body. The free end portion of the shorter shackle leg 28 enters through the circular entrance opening of the socket 26 in the platform surface 24 into the closed bottom socket 26, when the shackle is in locking position. By this construction, the shorter leg 28 of the shackle can be withdrawn a sufficient distance from the platform surface portion 24 of the padlock body to dispose its free end at or immediately above the level of the top surface 17 of the padlock body or of a slight recess provided therefor in the top surface, whereupon the shackle can be swung to an exposed position by rotating it about the axis of its longer leg 27 to the position illustrated in FIG. 1. The U-shaped shackle 22 also comprises the usual curved intermediate or bridging portion 29 extending between the legs 27 and 28, which serves as the portion which engages the laterally alined abutting hasp portions 14 of the pair of locking bars 11, 12 in the locking position. The apertures 14*a*, 14*b* of the hasp portions 14 of the locking bars are of a diameter closely approximating the diameter of the shackle and are adapted to register with each other to receive the shackle, so that when they are nested within the forward wing 21*c* and rearward slot portions 21*d* of the cruciform shaped recess 20, with the upwardly arching bridge portion 29 of the shackle extending through the alined locking bar apertures 14*a*, 14*b*, the locking bar hasp portions are securely held and protected against attack from the sides or the front.

The shackle legs 27 and 28, in accordance with usual practice, have confronting notches 27*a*, 28*a* located within the padlock body when the shackle is in the locking position and disposed to receive end portions of a rotatable locking bolt 30 of conventional construction, for example of the type disclosed in earlier U.S. Pat. No. 3,713,309 to Harry C. Miller. The padlock body 15 also includes a closed bottom lower central bore portion 31, in the illustrated embodiment, which communicates with the sockets 25 and 26 and is shaped and sized to accommodate a key lock plug 32, which may be of conventional construction, having the usual rotatable plug therein responsive to insertion of the proper key through a key opening in the bottom surface 19 of the padlock body to effect rotation of the bolt member 30 through a sufficient angle to withdraw it send portions from the confronting locking notches *27a, 27b* in the shackle legs and release the shackle to be manually withdrawn outwardly of the padlock body parallel to the axis of the longer shackle leg and then rotated about that axis to shift the shackle to a position permitting it to be withdrawn from the hasp portions of the locking bars.

The locking bolt 30 and the mechanism by which it is operated from the rotatable plug of the key lock cylinder may be like the construction disclosed in the earlier Miller U.S. Pat. No. 3,713,309, and the padlock body may be provided with a closure seal of the slide type as disclosed in that patent or a closure seal of the rotatable type as disclosed in the companion Miller U.S. Pat. No. 3,710,613, to permit selective opening of the closure seal over the housing cavity for the key lock cylinder and replacement of the key lock cylinder in the manner described in either of those earlier patents.

Figure 5:
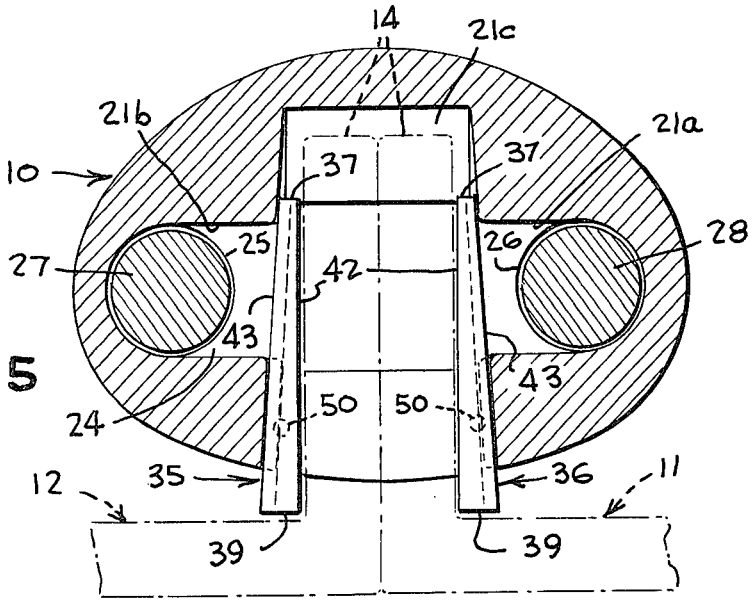
FIGS. 5 and 6 are fragmentary horizontal section views taken along the lines 5—5 and 6—6 of FIG. 3, showing the anti-wedge device in normal position.
Figure 7:
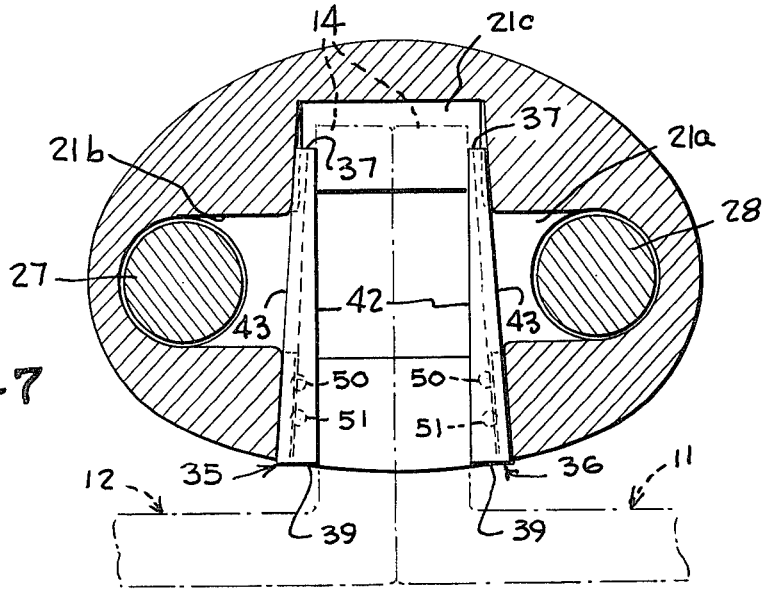
FIG. 7 is a fragmentary horizontal section view taken along the same section plane as FIG. 5, but showing the anti-wedge device in the position to which it is driven by a wedge during attack.
Figure 6:
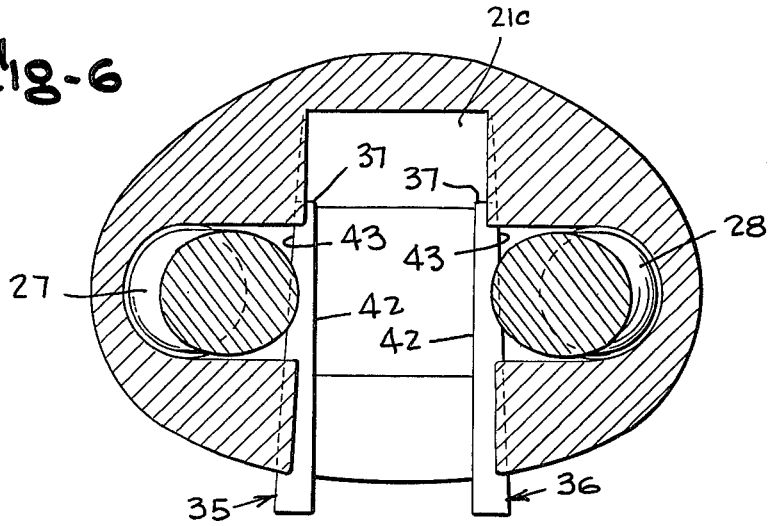

It will be appreciated that locks of this construction may be forcibly driven off of the locking bars 11, 12 by inserting the sharp ends of heavy metal wedges herein referred to as destructive wedges, directed downwardly, laterally or upwardly against the upper rear wall portions of the padlock body between the mounting base or foot portions 13 of the locking bars and the rear of the padlock body, and driving them by sledges or heavy hammering tools so as to exert great outward wedging forces against the padlock body and thereby tear the case hardened shackle 22 forwardly through the apertured hasp portions 14 nested within the recess portions *21c, 21d* of the cruciform recess 20. To resist destruction of the security of the padlock and locking bar assembly by such wedge destruction techniques, the padlock of the present invention is additionally provided with a special anti-wedge mechanism in the form of a pair of attack-resisting wedges, indicated by reference characters 35, 36, which are located along the opposite sides of the rearwardly opening recess *21d* against the lock body to dispose the rear larger end portions of the attack-resisting wedges or "flanking wedges" 35, 36, in the path of attack of any destructive wedges which one may attempt to insert between the padlock body and the base or foot portions of the locking bars to lend additional support to and exert greater holding action on the locking ear or apertured hasp portions 14 of the locking bars and further resist tearing of the shackle from the locking bars. In the illustrated embodiment, flanking wedges 35, 36 are made in the form of a pair of like, integral wedge-shaped members having a height approximating the distance from the bottom of the rearwardly opening entrance slot 21d of the padlock body recess for the locking bar hasp portions 14 and the underside of the bridging portion or arched portion 29 of the padlock shackle 22. The integral wedge members 35, 36 have a narrower, nearly pointed forward end 37 and a rearward wider end 39 protruding rearwardly from the rear surface of the lock body as shown in FIG. 1, and have flat top and bottom surfaces 40, 41. The confronting or inwardly facing surfaces 42 of the attack-resisting wedges 35, 36 are spaced apart a distance closely approximating the transverse thickness of the pair of hasp portions 14 of the locking bars when in registered abutment and the opposite or laterally outwardly facing surfaces 43 of the wedges 35, 36 penetrate into channel recesses 44 in the confronting wall portions of the cruciform recess wings *21c* and *21d* to capture the wedges 35, 36 in the lock body. To provide rigid guiding support for these attack-resisting wedges 35, 36, dove-tail guide grooves 45 extend inwardly from the surfaces 43 to interfit with dove-tail ribs 46 on the base walls 47 of channel recesses 44 to confine the wedges 35, 36 to rectilinear forward movement from the position shown in FIG. 5. The wedge members 35, 36 are restrained against accidental dislodgement from the guide channel formations therefor formed in the cruciform recess 21 by any suitable detent means, such as by a spring loaded detent ball 50 formed in a drilled cylindrical socket therefor opening through the lower surface of the bottom wall portion 41, which is resiliently urged to releasably protrude into a spherical detent recess 51 in the confronting bottom wall portion of the cruciform recess 21. Alternatively, a frangible pin may be seated in a drilled socket therefor in the portions of the lock body overlying the portions of the wedge members 35, 36 nested in the channel recesses 44 therefor, which protrudes below the upper surface of the channel recess into a drilled socket or forwardly extending slot formed in the top surface of the wedge members 35, 36 at an appropriate location to receive the downwardly protruding portion of the restraining frangible pin when the wedge members 35, 36 are located at the proper position. Also or alternatively, springs 54 may be provided in cavities 55 therefor in the forward portions of the front recess wing 21c to continuously bias the wedges 35, 36 to their normal positions.

It will be appreciated that with this construction, any attempt to forcibly wedge the padlock body off of the locking bars 11, 12 by the usual wedge attack techniques would cause the attack or driving wedges, when driven between the rear wall portion of the padlock body and the closely adjacent forwardly facing surfaces of the locking bar mounting base portions 13, will bring the driving wedges into engagement with the rear ends 39 of the attack-resisting wedges 35, 36 and, to the relative angular dispositions of the confronting surfaces 43 and 47 of the wedges 35, 36 and the confronting padlock body portions respectively, causing movement of the attack-resisting wedges 35, 36 inwardly by the driven wedges, eliminating all clearances between the inwardly facing surfaces 42 of the wedges 35, 36 relative to the combined thickness of the laterally abutting and alined hasp portions 14 of the locking bars. The effect of the driving of the attack-resisting wedges 35, 36 forwardly relative to the padlock body by the driven attack wedges and the coaction of the inclined surfaces described above causes the wedges 35, 36 to progressively tighten the binding action between their surfaces 42 and the locking bar hasp portions 14 to both reinforce the hasp portions and more tightly grasp them against being torn from the cruciform recess 21 of the padlock body. If desired, the confronting surfaces 42 of the portions of the attack-resisting wedges 35, 36 which are forced intoclamping action with the surfaces of the locking bar hasp portions 14 can be roughened by various treatment to further enhance the binding action, and can, if desired, be provided with saw tooth configurations as shown at 42*a* in FIG. 8, file-like roughened surface or the like may be provided, to greatly enhance the holding action of the wedges 35, 36 and padlock body on the locking bar hasp portions 14. Alternatively, the gripping faces 42 of the attack-resisting wedges 35, 36 may be formed with rough carbide surfaces processed in accordance with known methods to dig into the surfaces of the hasp formations 14 when forced forwardly by attack driving wedges.

Figure 8:
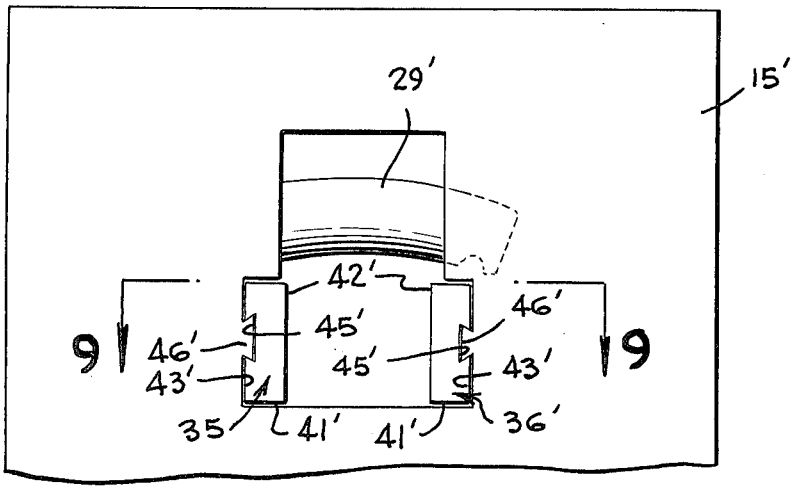
FIG. 8 is a fragmentary vertical rear elevation view similar to FIG. 4 showing the anti-wedge mechanism of the present invention applied to a concealed shackle padlock construction.
Figure 9:
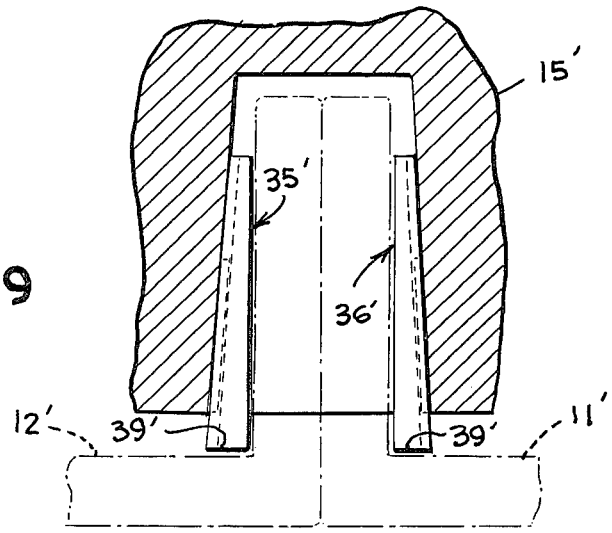
FIG. 9 is a fragmentary horizontal section view thereof taken along the line 9—9 of FIG. 8.

An alternate version is illustrated in FIGS. 8 and 9 in fragmentary form, wherein the attack resisting or attack reactive wedge members, here indicated by reference characters 35', 36', extend alongside the lateral bounding wall portions of the rearwardly opening cavity 21' of a concealed shackle padlock body 15' to flank the opposite side portions of the pair of laterally alined abutting hasp portions 14' of the locking bars 11', 12' to operate in the same fashion as the attack resisting wedges 35, 36 of the first described embodiment. As in the first embodiment, the preferred embodiment herein illustrated for concealed shackle padlocks has a pair of dove-tail guide grooves 45' in the outwardly facing or camming surfaces 43' of the wedge members 35', 36' receiving dove-tail ribs 46' formed along the lateral bounding walls of the cavity 21' to guide the wedges along predetermined rectilinear paths as they are driven forwardly by the attack wedges. The concealed shackle padlock includes a bolt or shackle member 29', which may be straight or curved, and which is actuated by usual bolt activating structure as known in the art in connection with previously available or publicly disclosed concealed shackle padlocks.

What is claimed is:

1. A high security padlock for securing in locked condition a pair of companion locking bars having ends providing apertured hasp portions to be locked together in parallel, laterally alined abutment, the padlock comprising a strong penetration and distortion resistant padlock body having a rearwardly opening cavity bounded by a pair of laterally spaced vertical bounding wall surfaces to receive the alined abutting hasp portions therebetween in enshrouded relation shielded by the padlock body against access by attacking tools directed from the front, sides, or bottom of the lock body, the padlock including a shackle movable from a locking position extending transversely through the cavity and through the apertures of the abutting hasp portions therein and a retracted position enabling withdrawal of the hasp portion from the cavity, a lock mechanism within the padlock body for locking the shackle in said locking position and releasing the same for movement to the retracted position; the improvement comprising reactive wedge structure for resisting destructive attack responsive to driving wedge-type attack tools in the zone located between the rear of the padlock and a rearwardly adjacent stationary surface of a portion of the locking bars or adjacent wall surface or the like by persons seeking destructive tearing of the padlock shackle forwardly through the hasp portions, the reactive wedge structure comprising an attack reactive wedge member extending forwardly into the cavity alongside the laterally alined abutting hasp portions between the adjacent lateral surface of the adjacent hasp portion and the confronting bounding wall surface, said wedge member having a contact surface and a camming surface forming oppositely facing forwardly converging lateral surfaces thereof disposed adjacent and confronting the last mentioned hasp and bounding wall surfaces, respectively, providing a wider rear end portion projecting through said rearward opening for a predetermined distance beyond the rear of the lock body into said zone to be engaged by the attacking tool when driven between the lock body and rearwardly adjacent surface, and said lock body having portions along said confronting bounding surface adjacent the wedge member for imparting a predetermined component of lateral hasp gripping movement to the wedge member toward the opposite bounding wall surface when the wedge member is driven forwardly by the attacking tool and thereby bring portions of the padlock into increasingly tightening gripping engagement with the opposite lateral surfaces of said hasp portions for resisting destructive tearing and withdrawal of the hasp portions from the cavity.

2. A high security padlock as defined in claim 1, wherein said reactive wedge structure comprises a pair of said attack-resistive wedge members located respectively on opposite sides of the pair of laterally alined abutting hasp portions in the cavity between the adjacent lateral surfaces of the hasp portions and the confronting bounding wall surfaces of the cavity and each having their wider rear end portions projecting similar distances rearwardly beyond the rear surface of the lock body into the zone to be engaged by the attacking tool.

3. A high security padlock as defined in claim 1, wherein said reactive wedge member includes an integral outwardly projecting guide rib of dove-tail cross section projecting from the cam surface thereof in a direction away from the fore and aft center axis of the lock body and extending in a rectilinear fore and aft direction, and the adjacent confronting bounding wall surface of the cavity having a correspondingly shaped dove-tail guide groove therein in which the dove-tail guide rib of the reactive wedge member is slidably disposed to accommodate a predetermined amount of forward movement of the wedge and guide the wedge along a rectilinear path.

4. A high security padlock as defined in claim 2, wherein said pair of reactive wedge members each include an integral outwardly projecting guide rib of dove-tail cross section projecting from the cam surface thereof in a direction away from the fore and aft center axis of the lock body and extending in a rectilinear fore and aft direction, and the adjacent confronting bounding wall surface of the cavity having a correspondingly shaped dovetail guide groove therein in which the dove-tail guide rib of the reactive wedge member is slidably disposed to accommodate a predetermined amount of forward movement of the wedge and guide the wedge along a rectilinear path.

5. A high security padlock as defined in claim 1, including means for restraining the reactive wedge member against accidental dislodgement from the cavity including a restraint formation projecting from a surface of the reactive wedge member and the confronting bounding portion of the cavity having a recess therein for receiving said formation whereby the walls of said recess resist withdrawal of the wedge member outwardly from the cavity from its normal position therein.

6. A high security padlock as defined in claim 2, including means for restraining each of said reactive wedge members against accidental dislodgement from the cavity including a restraint formation projecting from a surface of the reactive wedge member and the confronting bounding portion of the cavity having a recess therein for receiving said formation whereby the walls of said recess resist withdrawal of the wedge member outwardly from the cavity from its normal position therein.

7. A high security padlock as defined in claim 3, including means for restraining the reactive wedge member against accidental dislodgement from the cavity including a restraint formation projecting from a surface of the reactive wedge member and the confronting bounding portion of the cavity having a recess therein for receiving said formation whereby the walls of said recess resist withdrawal of the wedge member outwardly from the cavity from its normal position therein.

8. A high security padlock as defined in claim 4, including means for restraining each of said reactive wedge members against accidental dislodgement from the cavity including a restraint formation projecting from a surface of the reactive wedge member and the confronting bounding portion of the cavity having a recess therein for receiving said formation whereby the walls of said recess resist withdrawal of the wedge member outwardly from the cavity from its normal position therein.

9. A high security padlock as defined in claim 1, wherein said padlock body is in the form of a shrouded shackle padlock having a cruciform shaped recess opening through the top of the padlock body for receiving the padlock shackle and the alined abutting hasp portions therein, the padlock shackle being of the U-shaped shackle type having a pair of laterally spaced shackle legs and an upwardly arching bridge portion to extend through the hasp portion apertures, and said cruciform shaped recess having a pair of laterally extending wings defining a first laterally elongated recess dimensioned to correspond substantially to the maximum distance between the outer edge portions of the shackle legs and the cruciform shaped recess having forward and rearward extensions defining a second recess elongated in a fore and aft direction and opening rearwardly through the padlock body dimensioned to closely correspond to the combined transverse thickness of the abutting laterally alined hasp portions and the reactive wedge structure for receiving the same in said cavity.

10. A high security padlock as defined in claim 3, wherein said padlock body is in the form of a shrouded shackle padlock having a cruciform shaped recess opening through the top of the padlock body for receiving the padlock shackle and the alined abutting hasp portions therein, the padlock shackle being of the U-shaped shackle type having a pair of laterally spaced shackle legs and an upwardly arching bridge portion to extend through the hasp portion apertures, and said cruciform shaped recess having a pair of laterally extending wings defining a first laterally elongated recess dimensioned to correspond substantially to the maximum distance between the outer edge portions of the shackle legs and the cruciform shaped recess having forward and rearward extensions defining a second recess elongated in a fore and aft direction and opening rearwardly through the padlock body dimensioned to closely correspond to the combined transverse thickness of the abutting laterally alined hasp portions and the reactive wedge structure for receiving the same in said cavity.

11. A high security padlock as defined in claim 5, wherein said padlock body is in the form of a shrouded shackle padlock having a cruciform shaped recess opening through the top of the padlock body for receiving the padlock shackle and the alined abutting hasp portions therein, the padlock shackle being of the U-shaped shackle type having a pair of laterally spaced shackle legs and an upwardly arching bridge portion to extend through the hasp portion apertures, and said cruciform shaped recess having a pair of laterally extending wings defining a first laterally elongated recess dimensioned to correspond substantially to the maximum distance between the outer edge portions of the shackle legs and the cruciform shaped recess having forward and rearward extensions defining a second recess elongated in a fore and aft direction and opening rearwardly through the padlock body dimensioned to closely correspond to the combined transverse thickness of the abutting laterally alined hasp portions and the reactive wedge structure for receiving the same in said cavity.

* * * * *